US005475962A

United States Patent [19]

Horsten et al.

[11] Patent Number: 5,475,962

[45] Date of Patent: Dec. 19, 1995

[54] PANEL SYSTEM AND A PANELLING MEMBER THEREFOR

[75] Inventors: Antonius J. J. Horsten, The Hague; Wilhelmus J. A. P. Oosterwijk, Delft, both of Netherlands

[73] Assignee: Hunter Douglas International N.V., Netherlands Antilles

[21] Appl. No.: 177,253

[22] Filed: Jan. 4, 1994

[30] Foreign Application Priority Data

Jan. 7, 1993 [GB] United Kingdom ..... 9300478

[51] Int. Cl.[6] ..... E04B 1/38

[52] U.S. Cl. ..... 52/506.08; 52/506.06; 52/762

[58] Field of Search ..... 52/506.01, 506.04, 52/506.08, 506.06, 506.09, 506.1, 478, 762, 763, 475.1, 479, 483.1, 489.2, 489.1, 766, 772, 773, 774

[56] References Cited

U.S. PATENT DOCUMENTS 3,741,843 6/1973 Louis .

4,646,506 3/1987 Slapsys ..... 52/506.08 X

FOREIGN PATENT DOCUMENTS 1327617 4/1963 France ..... 52/506.08

*Primary Examiner*—Carl D. Friedman

*Assistant Examiner*—Creighton Smith

*Attorney, Agent, or Firm*—Gary M. Polumbus; Holland & Hart

[57] ABSTRACT

A panel system, particularly a false ceiling is constructed from a plurality of elongate panelling members arranged side by side. Each panelling member comprises three elongate slats arranged side by side and joined by flexible tape along adjacent edges. When laid out flat the panelling member may be coiled or easily stored but for installation in a ceiling the outside slats are folded perpendicular to the cental slat so as to provide the necessary rigidity.

29 Claims, 12 Drawing Sheets

PANEL SYSTEM AND A PANELLING MEMBER THEREFOR

FIELD OF THE INVENTION

The present invention relates to panel systems, for example, but not exclusively, ceiling panel systems for false ceilings, panelling members to be made up into such panel. systems and methods of manufacturing and installing the panel and panelling members.

BACKGROUND OF THE INVENTION

Prefabricated panels are commonly used to form ceilings or walls and in many other places. Such panels are commonly made of sheets of material, for example aluminum alloy, and it is generally desirable to reduce the thickness of the panelling material so as to reduce its cost and weight. Reduction of thickness is however restricted by the necessity to retain sufficient strength and rigidity. It is also desirable that the panel is cheap to manufacture and easy to assemble in numerous different applications.

SUMMARY OF THE INVENTION

Accordingly the present invention provides a panelling member comprising at least two elongate sheet members hingedly joined along adjacent edges.

The sheet members are hingedly joined so that the panelling member can be folded or laid flat. When folded it will be rigid but when flat may be coiled. The present invention thus provides a panelling member which is easy to manufacture and may be readily stored and transported whilst rolled. The panelling member of the invention may be easily installed by unrolling it and hanging it on an appropriate carrier. If provided in long lengths it can be cut to fit on site so that there is no waste scrap.

The sheet members may be joined by strips of suitable flexible material such as plastic or fabric adhered or welded to the sheet members. They may also have a curved lateral cross section side by side.

The widths of the different elongate sheet members may be different, with central ones preferably wider. Decoration or perforation may be applied as desired for the particular application. The sheet members are preferably relatively rigid and may be made of, for example, aluminum alloy, other metals or rigid plastics type materials. The invention also provides a panel system comprising at least one panelling member mounted on a carrier.

When mounted on the carrier the or each central sheet member of the or each panelling member forms the outer surface of the panel while side sheet members are turned inwards for connection to the carrier and to provide rigidity.

The panelling member may be easily made in long lengths by drawing strips of the sheet material off rolls, bringing them side by side and applying a flexible connecting strip, such as an adhesive tape, along the join to form the hinge. With the multiple sheet members still retained generally coplanar, the panelling member may be easily coiled for ease of storage or transportation, but on installation, when the free edges are moved towards one another by folding the joint, sufficient rigidity is imparted to retain an elongate straight structure.

BRIEF DESCRIPTION OF THE DRAWINGS

The present invention will be further described hereinafter with reference to the following description of exemplary embodiments and the accompanying drawings, in which:

FIGS. 7 *g*) to *l*) are perspective views of example ceilings formed from panelling members according to embodiments of the invention;

DESCRIPTION OF THE INVENTION

Figure 1:
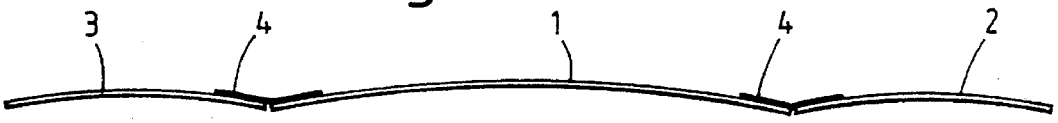
FIG. 1 is a cross-sectional view of an embodiment of a panelling member according to the invention in a flat state.
Figure 2:
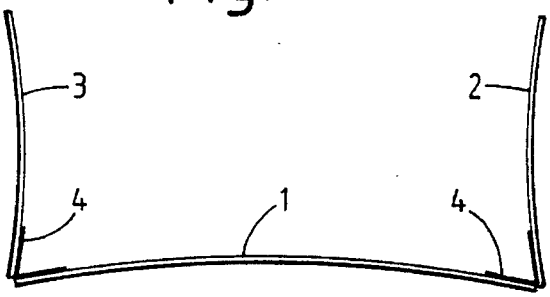
FIG. 2 is a cross-section of the panelling member of FIG. 1 in a folded state.

FIG. 1 is a cross-section of an embodiment of a panelling member or panel embodying the present invention with the panel shown in a flat state. The panel comprises three curved metal sheets or slats, 1, 2 and 3, joined together by a flexible tape 4. The panelling member according to the invention may also comprise only two slats. The slats are preferably made from a metal such as an aluminum alloy, and the adhesive tape from a plastics material. The middle slat 1 is considerably wider than the outer slats 2 and 3. FIG. 2 shows the same slat in cross-section when the side slats 2, 3 are folded upwards so as to form a channel. While in the FIG. 1 configuration the panelling member is quite flexible and may be coiled for ease of storage, in the FIG. 2 configuration it is much more rigid, sufficiently so to form a panel or part of a false ceiling.

Figure 3:
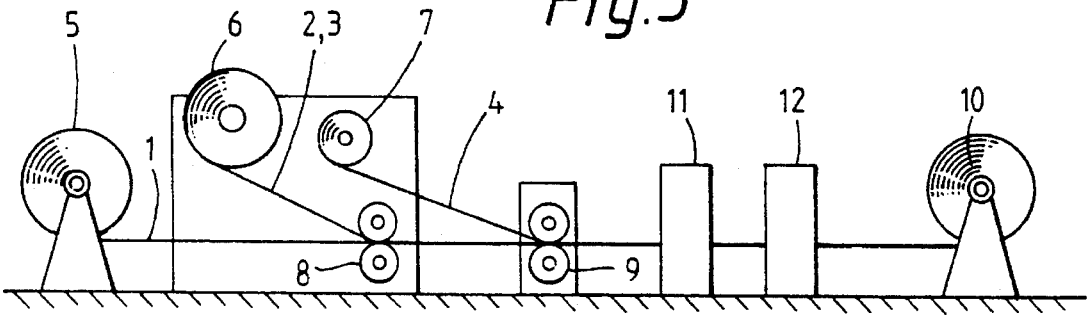
FIG. 3 is a schematic diagram of an assembly line for manufacturing panelling members according to the invention.

FIG. 3 illustrates a mechanism by which the panelling member can be constructed. The center slat 1 is unrolled from a supply roll 5 and the side slats 2, 3 are unrolled from supply rolls 6 and brought alongside the center slat at pinch rollers 8. If the slats are already crowned then rollers 8 may simply guide them together; however, if they are supplied flat rollers 8 may cold roll them into the desired cross-section. The adhesive tape 4 is supplied from a roll 7 and pressed onto the joint at rollers 9. The complete panel may then pass through a perforating station 11 which punches any holes desired for mounting or ventilation purposes, and a decorating station 12 which may apply any necessary surface finish or coating. The finished product is then rolled onto roll 10 or alternatively cut into lengths.

Figure 4:
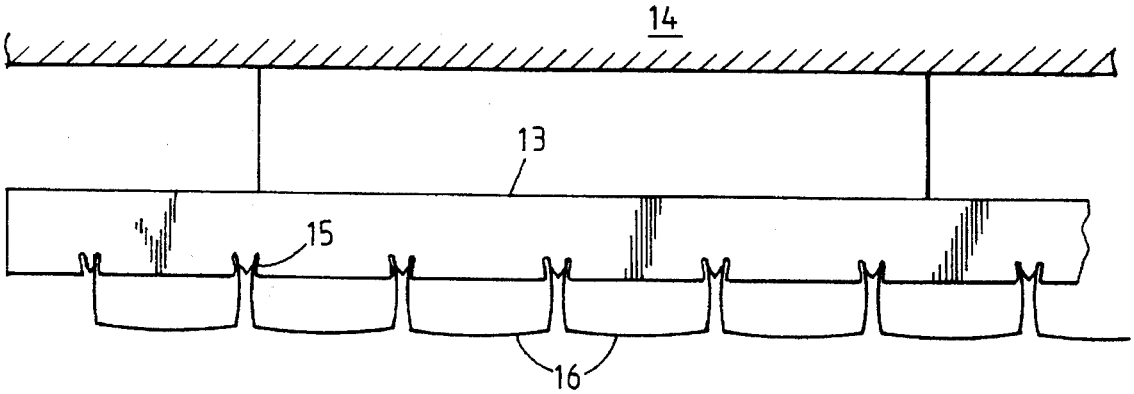
FIG. 4 is a sectional view of a false ceiling constructed from panelling members according to the invention.
Figure 5:
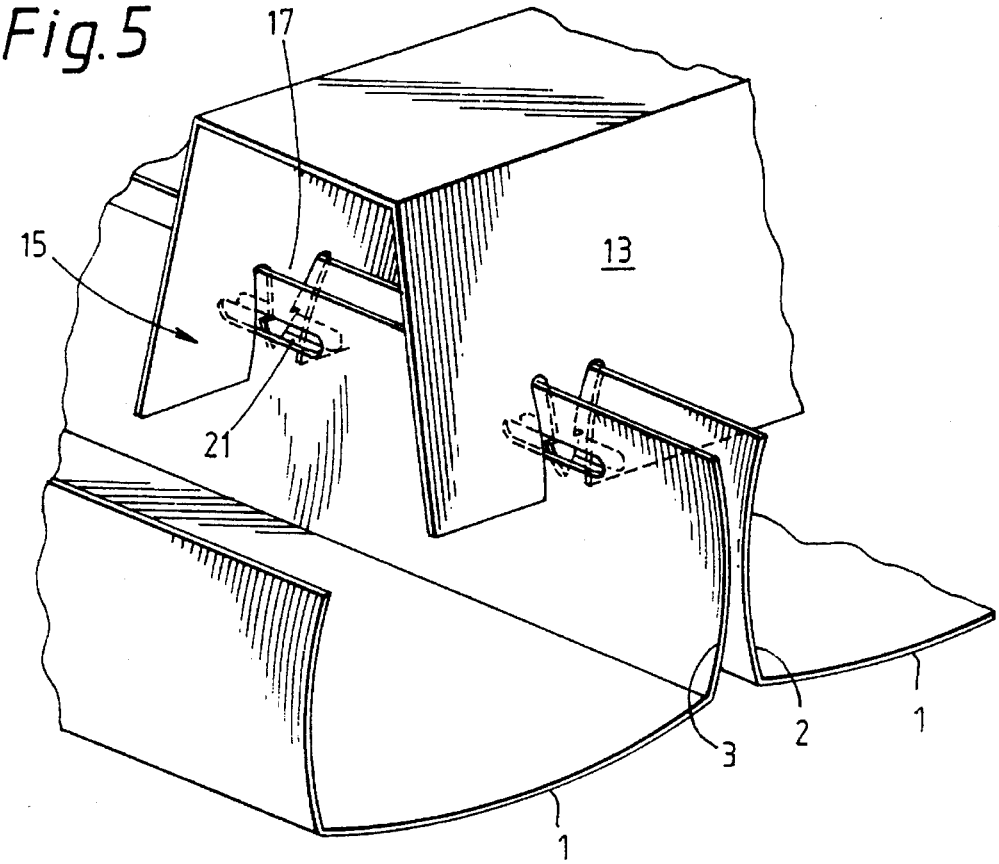
FIG. 5 is a close-up view of part of FIG. 4 showing how the panelling members are attached to carriers.
Figure 6:
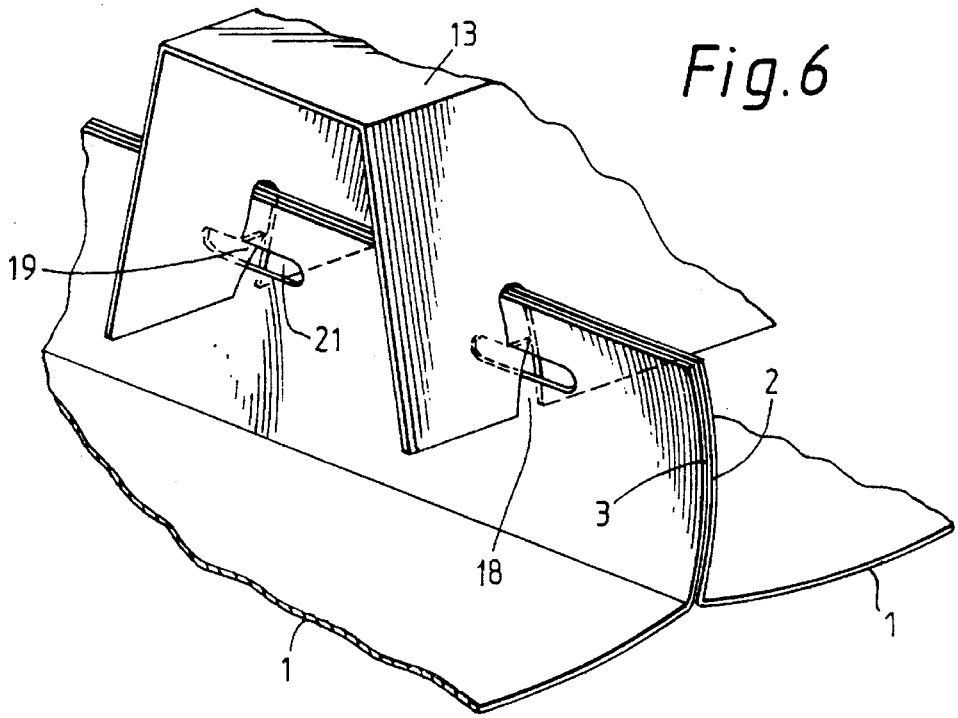
FIG. 6 is a view of an alternative method of fixing panelling members to the carrier.

FIG. 4 shows a false ceiling constructed using panelling members according to the invention. A carrier 13 is suspended from the true ceiling 14 at the desired height and perpendicular to the direction the elongate panelling members are to be arrayed. The carrier 13 has regularly spaced mounting points along its length onto which the lengths 16 of panelling are hung. FIG. 5 shows a carrier 13 and mounting points 15 in greater detail. The carrier 13 comprises an elongate inverted channel and the mounting points comprise notches 16 cut up into the side walls with a barbed projection 17 pointing downwards. During mounting of the panelling member, the free edges of the side slats are introduced into the notches 16 and slots 21 therein hook onto the barbs of the projection 17. The shape and width of the notches 15 relative to the side slats is chosen such that the side walls engage the opposite sides of the notches from the barbs to retain the slots 21 on the projection 17 and prevent movement of the side slats relative to the carrier FIG. 6 shows an alternative construction of the mounting point in which a single barb 19 is provided on one side of the notch 18 onto which are hung the side slats of two adjacent panelling members. As with the arrangement of figure 5, the notch is shaped to receive and retain the side slats. Alternatively a barb might be provided on each side of the notch. Many alternative constructions of the carrier are possible, for example it might comprise a long bar with appropriately spaced barbed projections depending therefrom.

Figure 7A:
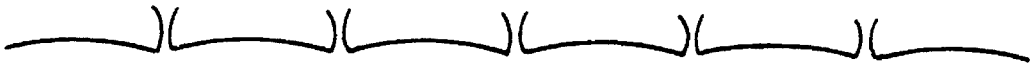
FIGS. 7 *a*) to *f*) are sectional views of how panels may be constructed from a plurality of panelling members.
Figure 7B:
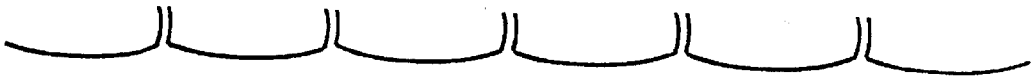
Figure 7C:
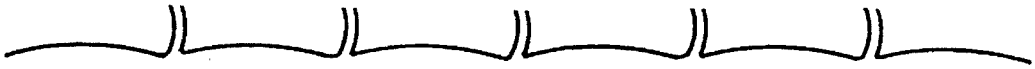
Figure 7D:
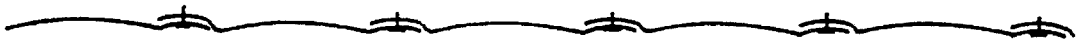
Figure 7E:
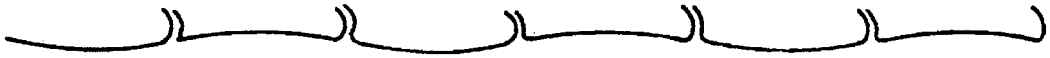
Figure 7F:
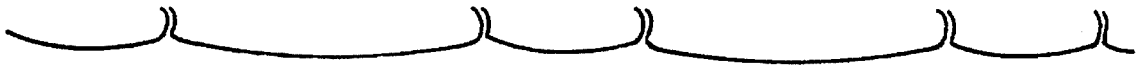
Figure 7:
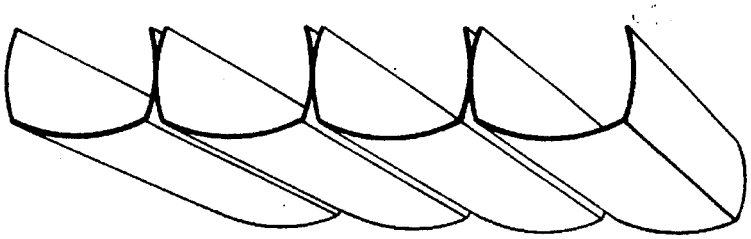
Figure 7:
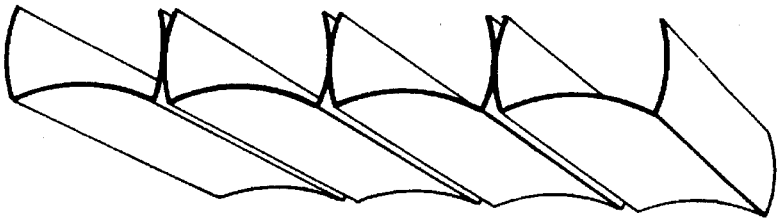
Figure 7:
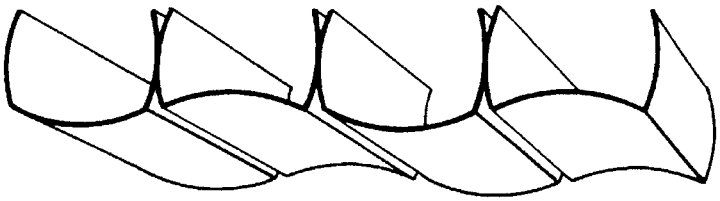
Figure 7:
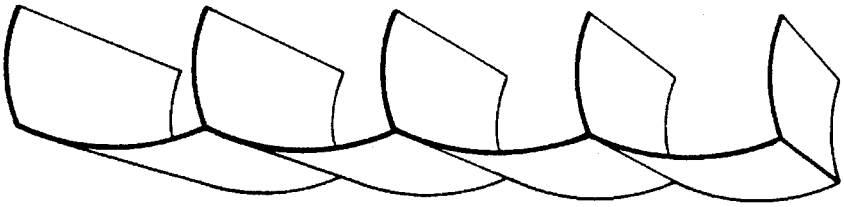
Figure 7:
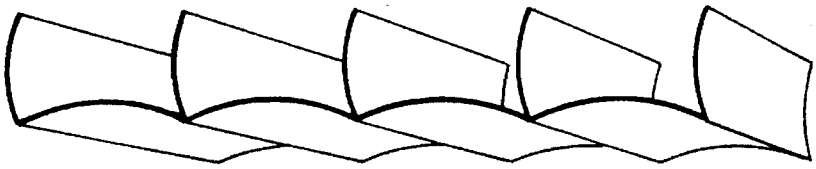
Figure 7:
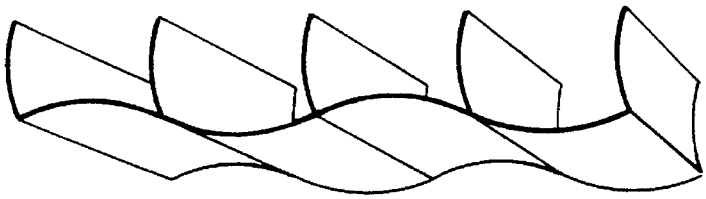

FIGS. 7 *a*) to *f*) illustrate potential variations in form of ceilings that can be provided with different panelling members. In FIG. 7*a*) the center slat of each panelling member is concave downwards while the side slats are convex facing one another. In FIG. 7*b*) the center slats are convex downwards while the side slats alternate concave convex so as to nestle together more closely. FIG. 7*c*) is similar but the center slats are concave downwards. In FIG. 7*d*) the center and side slats all have the same curvature but the side slats are overlapped and joined together rather than being hinged upwards.

FIG. 7 *e*) illustrates possible effects which may be achieved with panelling members alternately having convex and concave center slats. FIG. 7*f*) illustrates effects that may be achieved or with panelling members having center slats of different widths.

FIGS. 7*g*) to *l*) are perspective views of ceilings constructed from arrangements of panelling members similar to the panels of FIGS. 7*a*) to *f*). FIG. 7*g*) is a perspective view showing "open" joints between panelling members with three convex slabs. The arrangement in FIG. 7*h*) is similar but in this case the middle slat of each parallel member is concave. The side slats are still convex to produce "open" joints.

FIG. 7*i*) illustrates the "wave" effect achievable with alternate panel members having convex and concave central slats, in this case all of the side slats are concave to produce "open" joints.

FIGS. 7*j*) to 7*l*) show arrangements similar to FIGS. 7*f*) to 7*i*) but with "closed" joints formed by using panel members with side slats curved in opposite senses of curvature. The concave side slat of one panel member nests in the convex side slat of the adjacent panel member so as to provide a continuous outer surface.

Figure 8:
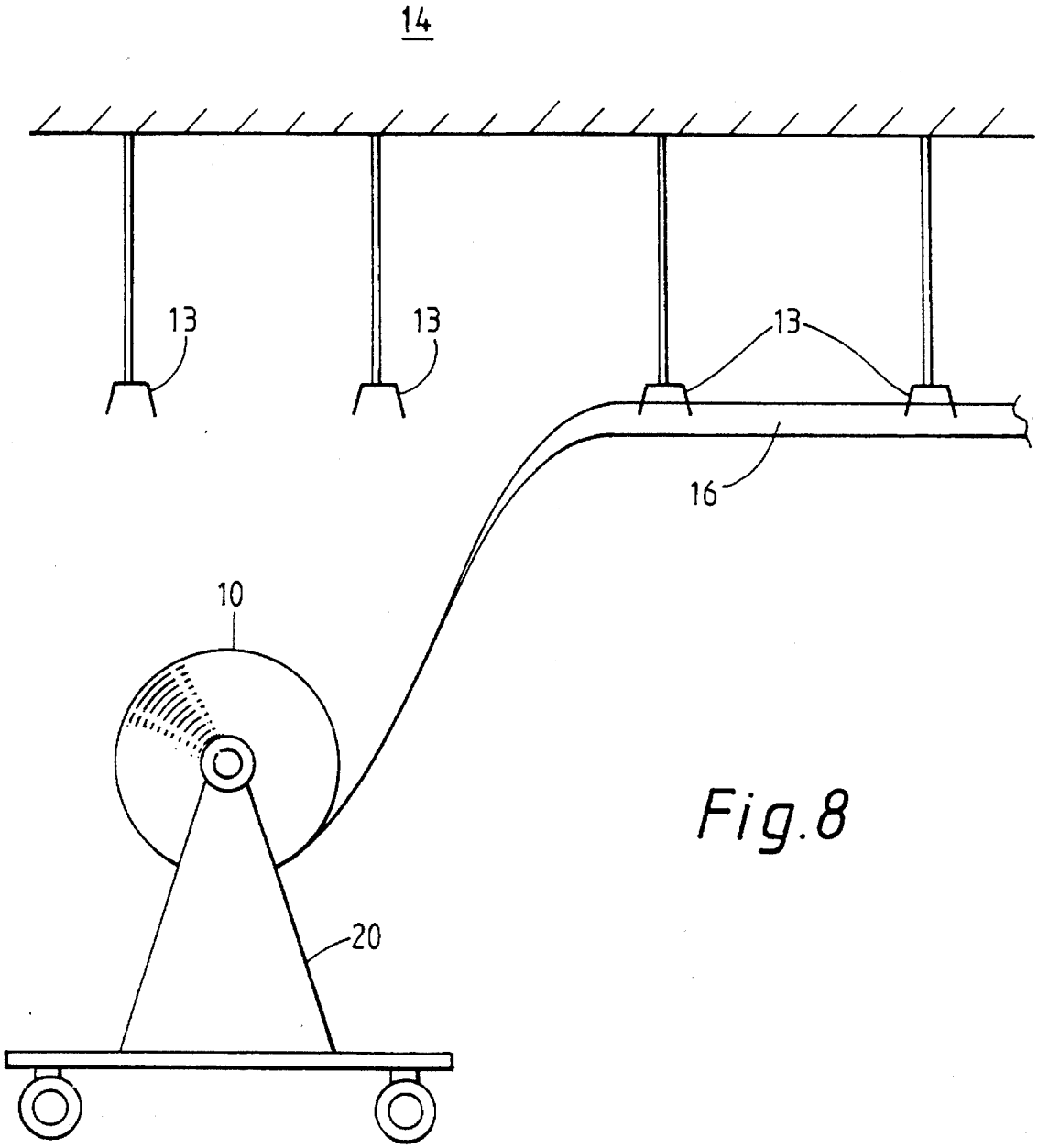
FIG. 8 is a schematic view of how the false ceiling may be constructed using panelling members according to the invention.

FIG. 8 shows how a false ceiling using panelling members according to the invention may be put up. First the carriers 13 are hung from the ceiling and then panelling member is unrolled from a roll 10, the sides hinged up and hung on the carriers. The roll 10 is provided on a trolley 20 which is then wheeled along as the panelling member is paid out and hooked onto the carriers.

The invention may also provide stiffening members with three or more similarly sized slats which can be folded to have a closed cross-section (not shown), in which form it is very rigid, yet when unfolded can be laid out flat for rolling or storage.

A length of panelling member may be formed of several simple three part members joined side by side in any of the arrangements shown above.

Figure 9:
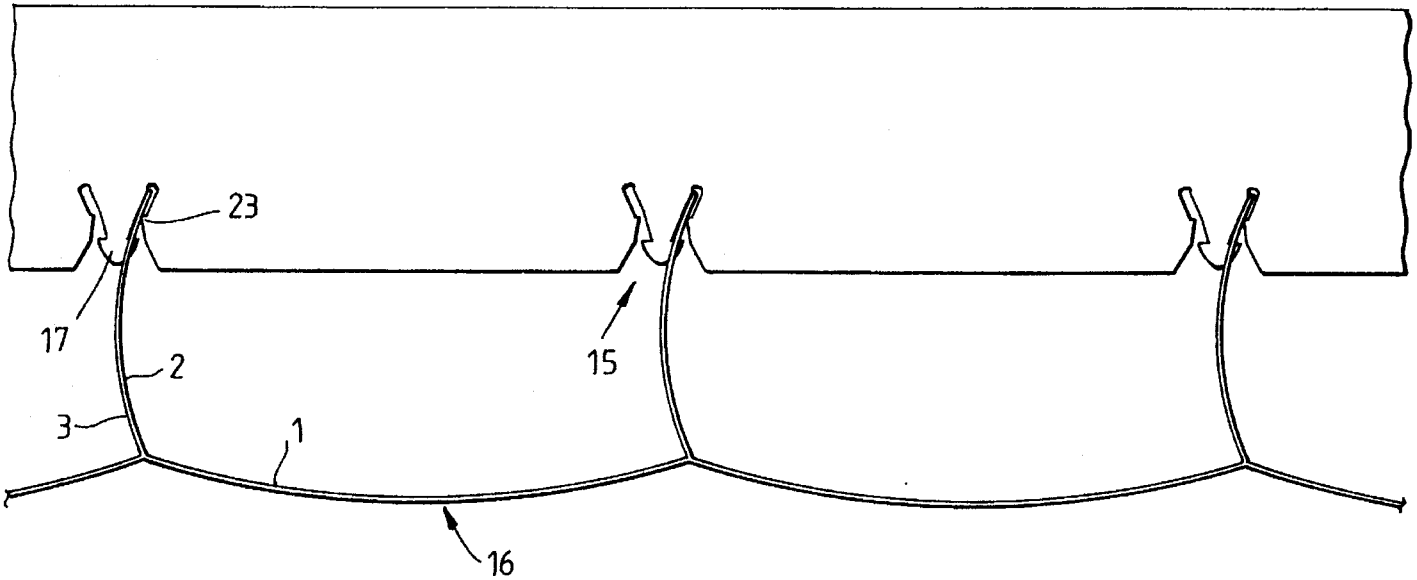
FIGS. 9, 10 and 11 are cross-sectional views of false ceilings according to an embodiment of the invention.

FIG. 9 shows in cross-section a false ceiling according to the invention similar to that shown in FIG. 5. In this embodiment the panel member 16 is constructed from a convex central slat and two side slats 2 and 3 one of which is convex and the other concave. Adjacent panelling members nest to provide a closed joint and the two side slats engage the barred projection 17. An additional detent projection 23 is provided on the side of notch 15 to engage the side slats of the panel members and hold them onto the barbed projection. Two adjacent side slats are engaged to one of slots formed on one side of the barbed projection.

Figure 10:
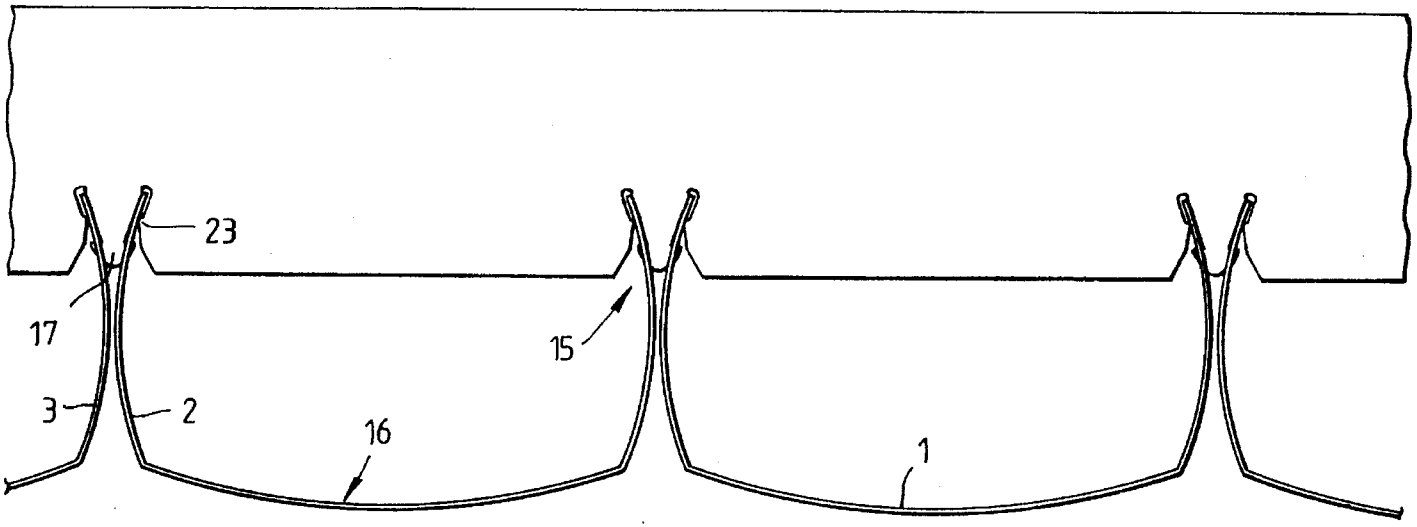

FIG. 10 shows a similar arrangement using the same carrier but in which all slats of the panel member are convex so as to provide "open" joints, and one side slat is engaged in each of the two slots formed beside the barbed projection.

Figure 11:
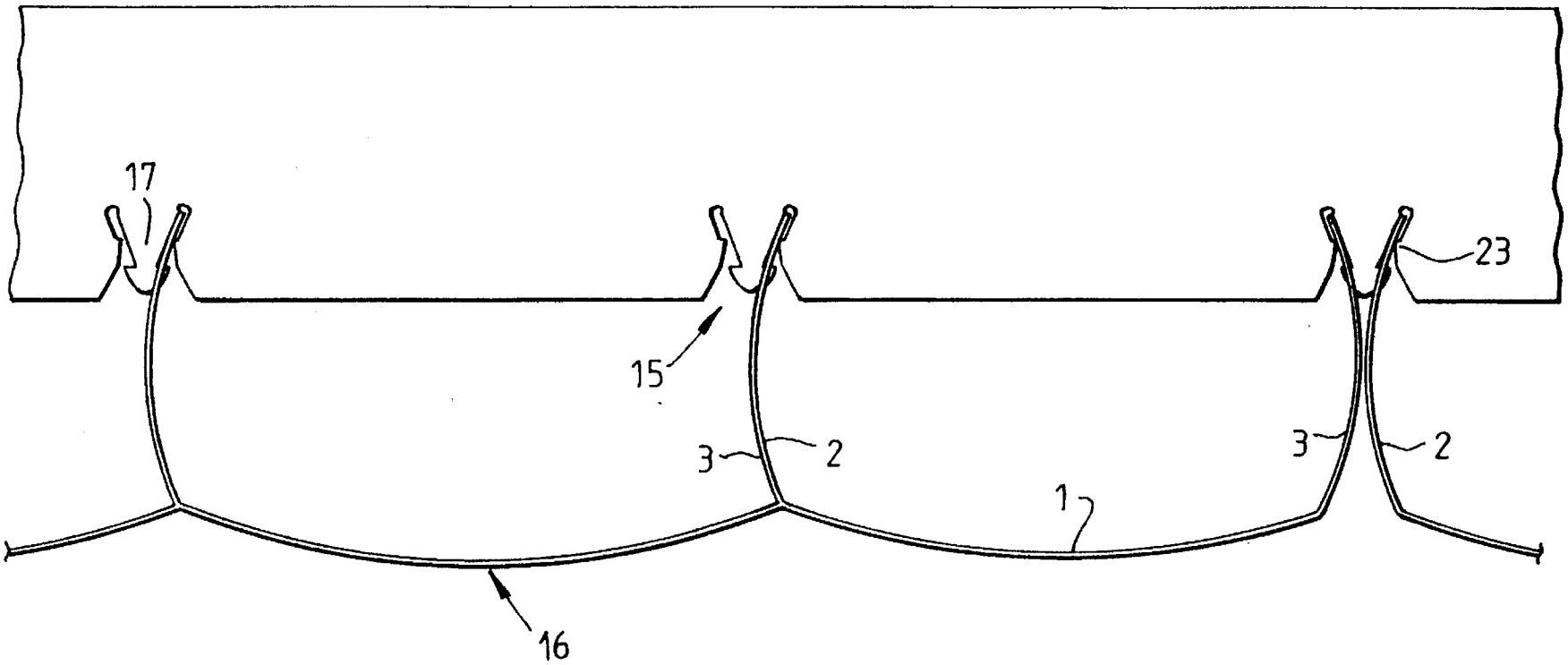

FIG. 11 is a still further similar embodiment in which different panelling members are combined on the same carrier as in FIGS. 9 and 10 so as to produce a desired arrangement of open and closed joints.

Figure 12:
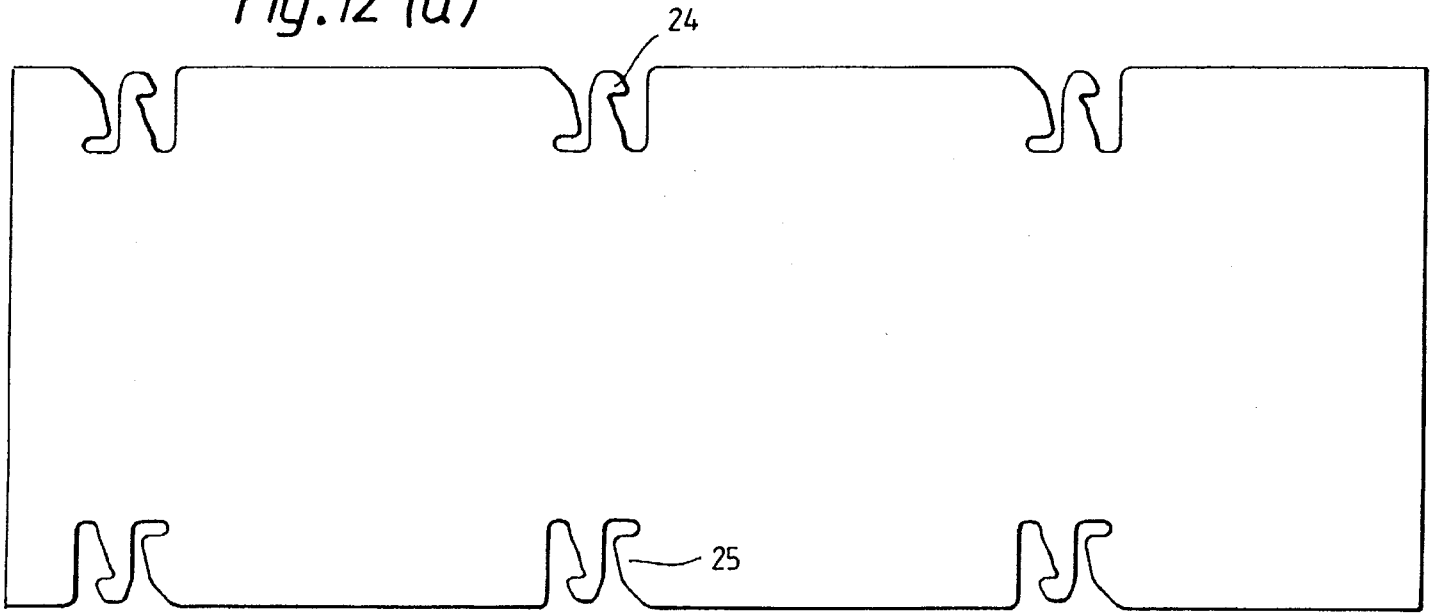
FIG. 12*a*) shows a blank to be formed into a carrier for use in the invention.
FIG. 12*b*) shows that carrier when folded.
FIG. 12*c*) is an enlarged view of a part of that carrier.
Figure 12:
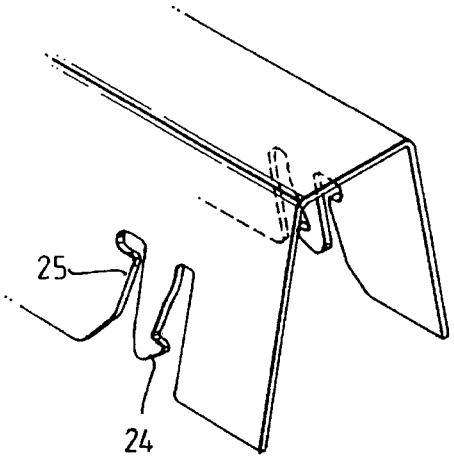
Figure 12:
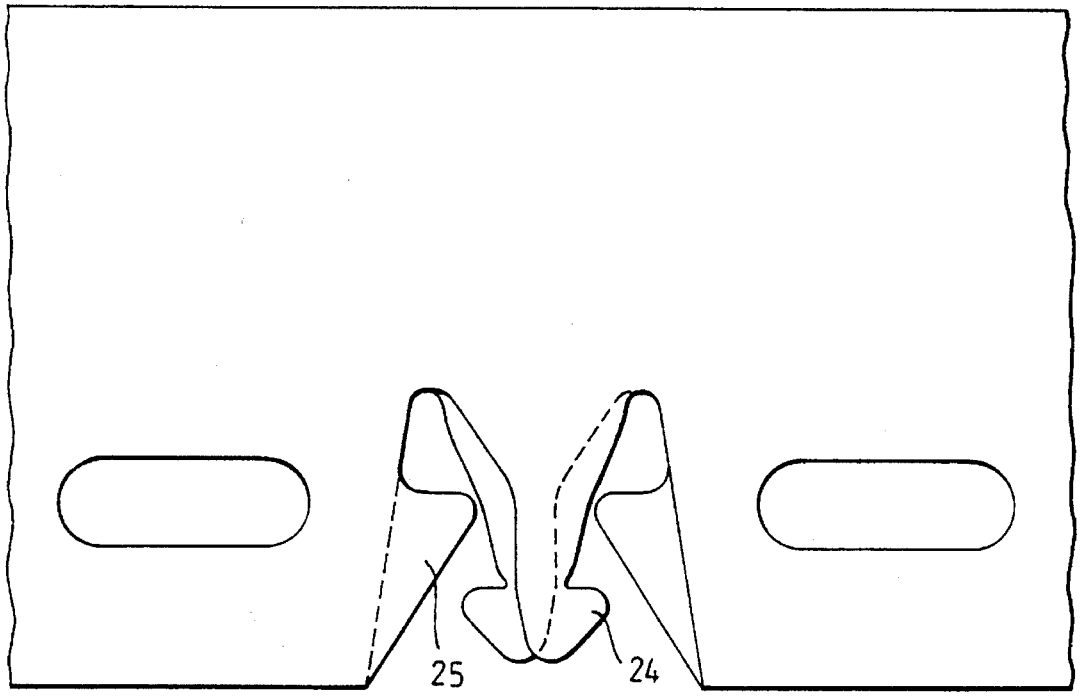

FIGS. 12*a*) to *c*) show a carrier which may be used with panelling members described above to form a false ceiling. FIG. 12*a* shows how notches are cut into the flat blank whilst FIG. 12*b* illustrates how that blank is folded by roll forming to form the channel shaped carrier. The notches cut on alternate sides of the blank are asymmetrical so that when folded a side slat hanging on barb 24 is held in place by detent 25 provided on the opposite side of the carrier. FIG. 12*c* is an enlarged side view of the folded carrier showing how the two notches cooperate to form two barb and detent pairs for holding side slats. This form of notch is advantageous in that it may be cut with a more sturdy punching tool.

Figure 13:
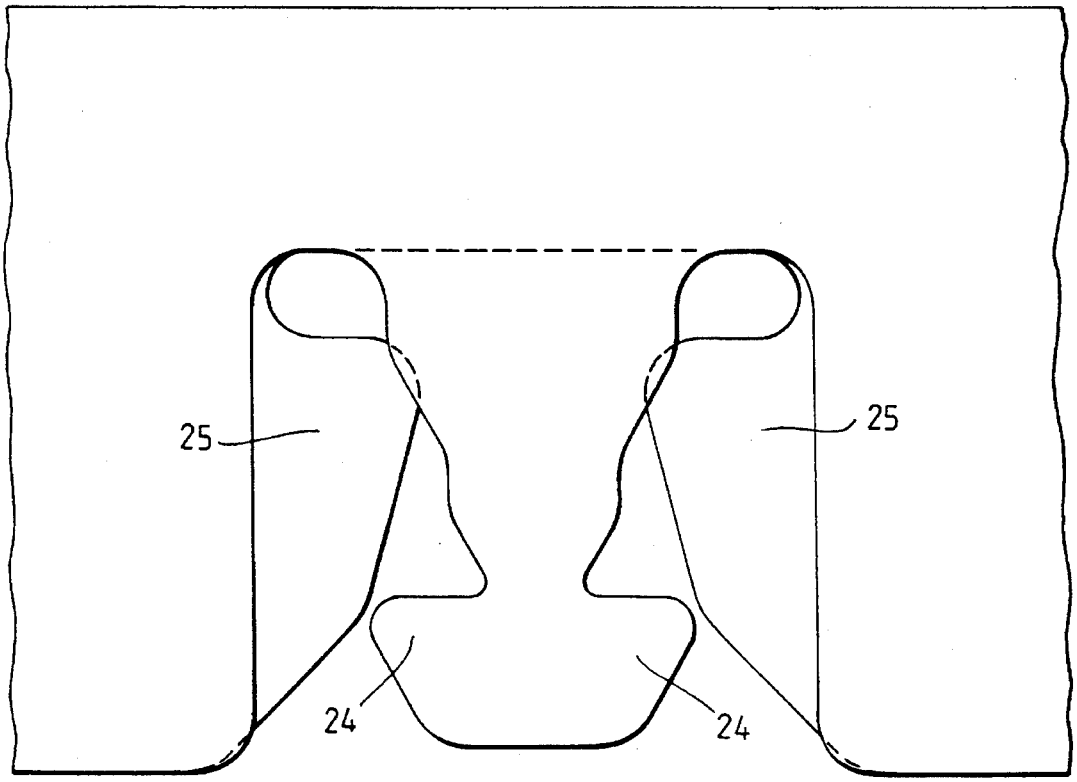
FIG. 13*a*) shows a blank to be formed into another carrier for use in the invention.
FIG. 13*b*) is an enlarged view of a part of that carrier.
Figure 13A:
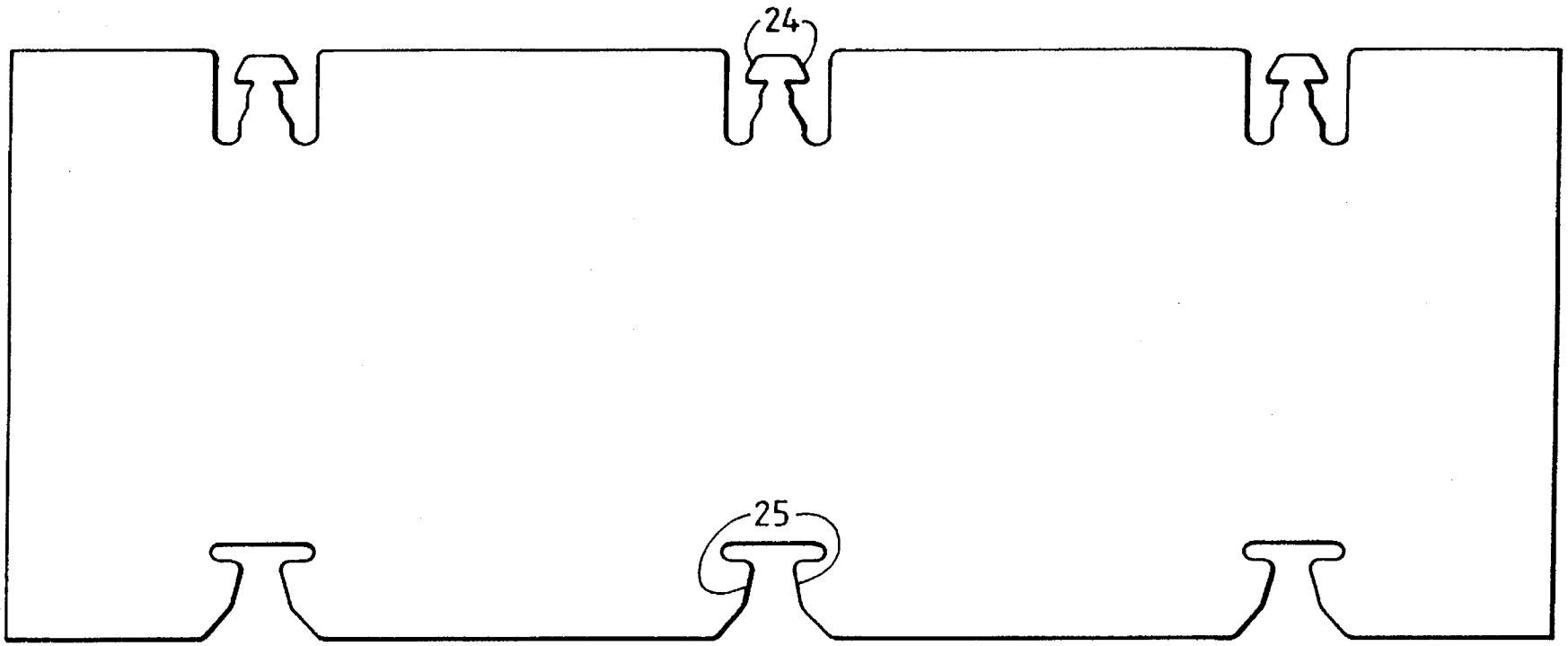

FIG. 13*a* shows the blank of a further form of carrier according to the invention, again with asymmetric notches. In this instance two barbs 24 are provided on one side and two detent members on the other. As will be seen in FIG. 13*b*, which is an enlarged view showing how the notches will overlap once the blank is folded into a channel section, these will cooperate to retain a side slat. The two forms of notch shown in this figure may be alternated on each side so as to eliminate any tendency of the long carrier to tilt.

Figure 14A:
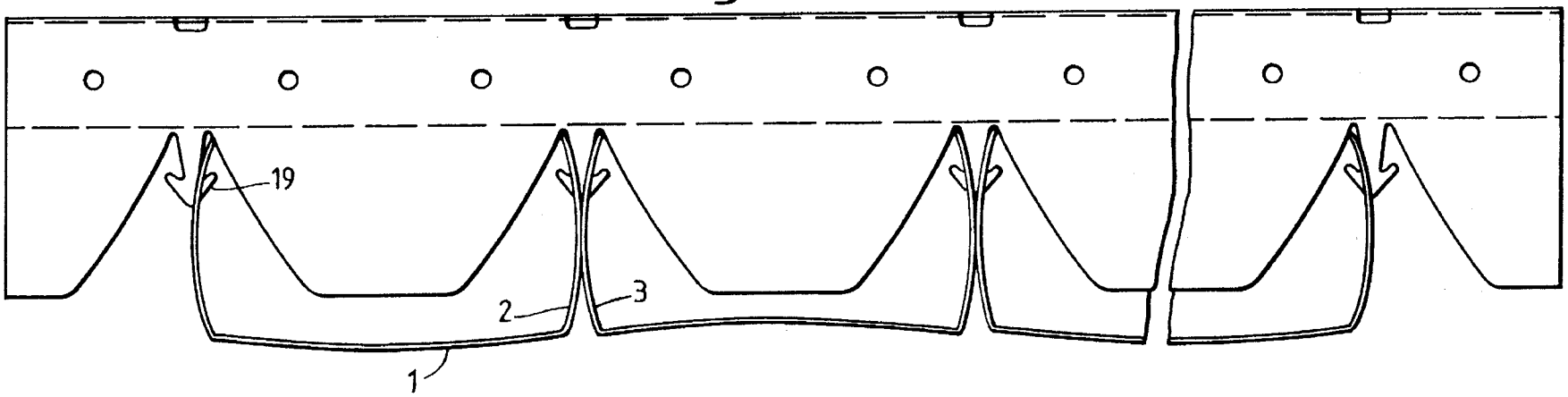
FIGS. 14*a*) and *b*) are side views of a further carrier for use in the invention and FIG. 14*c* is a side view of that carrier.
Figure 14B:
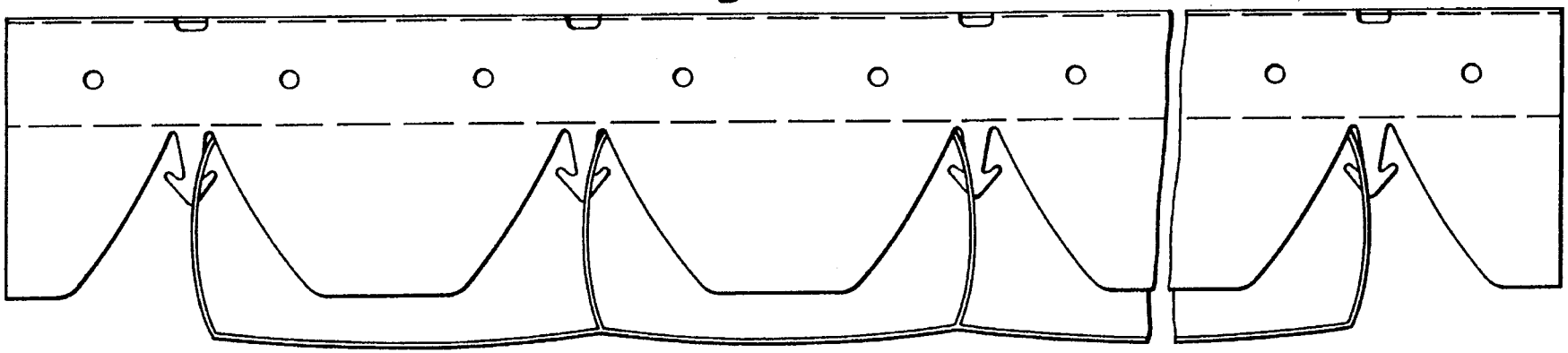

A still further form of carrier is shown in FIGS. 14*a*) to *c*). As will be seen the notch 15 in the carrier is very deep and has gently sloping sides. A relatively short barbed projection 19 is provided at the base apex, or deepest part of each notch 15. The curved relatively gently sloped sides of the notch 15 serve to guide the side slats 2 and 3 on to the projections during assembly. As shown in FIG. 14*a*) members having alternate convex and concave central slats are provided so as to form a wavy appearance. All of the side slats 2 and 3 are concave and engage opposite sides of the barbed projection so as to provide "open" joints. In FIG. 14*b* all of the central slats are convex but the side slats alternate concave and convex and engage the same side of the barbed projection so as to form "closed" joints.

Figure 14C:
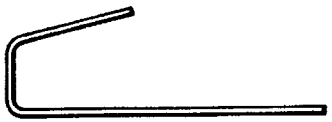

As shown in FIG. 14*c* the carrier itself is asymmetric. Only one of the depending flanges bears notches and the other is cut off short so as not to project below the top of the notches in the other flange.

Figure 15A:
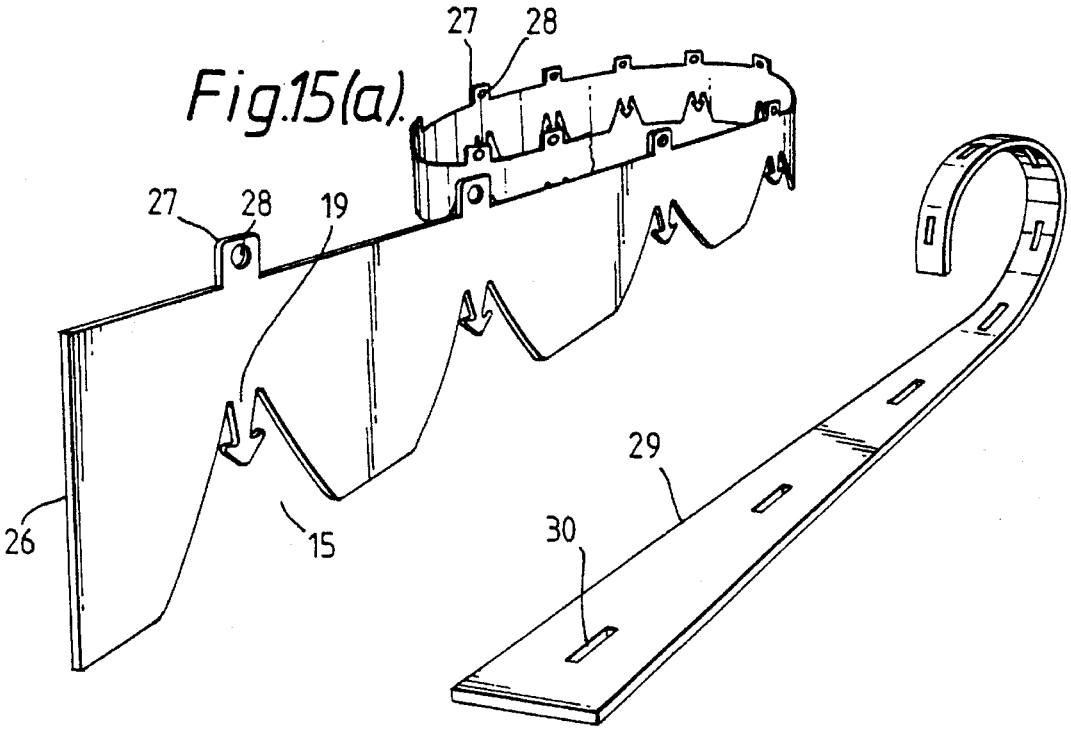
FIGS. 15*a*) and *b*) show the two components of a still further carrier according to the invention and that carrier as assembled.
Figure 15B:
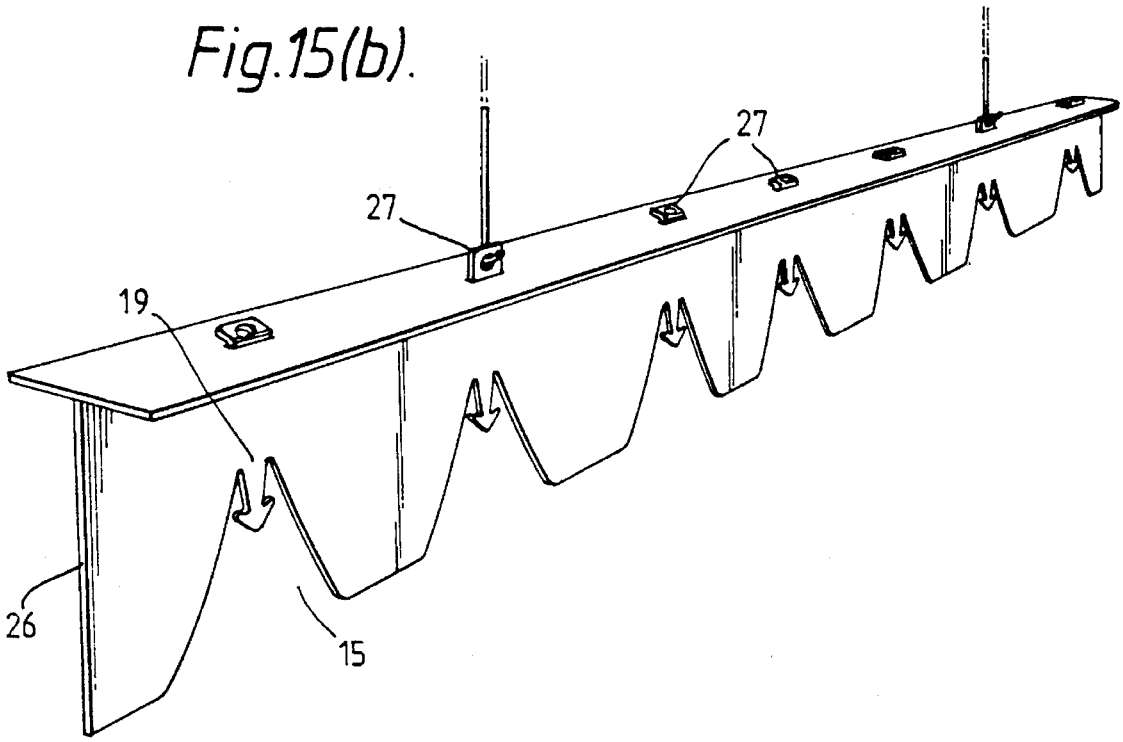

A still further example of a carrier according to the invention is shown in FIGS. 15*a*) and *b*). This carrier comprises two separate components both formed from a flat strip of metal or plastic. The first component or flexible, elongate web 26 has notches 15 and 19 cut at regular intervals into its lower edge and from its upper edge has upwardly directed projections 27 having holes 28 therein. The notches and barbed projections are preferably the same shape as in the embodiment of FIGS. 14*a*) and *b*). The upper projections 27 are also provided at regular intervals, but not necessarily the same as the lower notches. The second component or stiffening means 29 comprises a flat strip having apertures 30 at regular intervals matching those of the projections 27 on the first component 26. Both the first and second components 26, 29 may be coiled for easy storage and unrolled for assembly. The projections 27 are passed through the apertures 30 to form a composite body having sufficient rigidity. Some of the projections 27 are used to hang the carrier, while the remainder may be bent or twisted sideways to hold the two components together.

Because the two parts of this form of carrier may be rolled when separate they share the same advantages as the panelling member of the invention. For example, they are easy to manufacture, easy to transport and store when rolled and may be quickly and conveniently assembled without generating scrap.

We claim:

1. A panelling member comprising at least two elongate sheet members each having at least one edge and at least one sheet member having a curved lateral cross-section, said sheet members being placed side-by-side with said edges adjacent; and hinge means hingedly joining said sheet members.

2. A panelling member according to claim 1 wherein said hinge means comprises at least one strip of flexible material adhered to both side-by-side sheet members.

3. A panelling member according to claim 2 wherein said flexible material is a plastic material.

4. A panelling member according to claim 2 wherein said flexible material is a fabric.

5. A panelling member according to claim 1 wherein at least one of said sheet members is made from metal.

6. A panelling member according to claim 5 wherein at least one of said sheet members is made from an aluminium alloy.

7. A panelling member according to claim 1 comprising an odd number of sheet members and wherein at least a central one of said sheet members is wider than the others.

8. A panelling member according to claim 1 wherein at least one of said sheet members is decorated or perforated.

9. A panelling member according to claim 1 wherein at least two of said sheet members are laterally curved in the same sense of curvature.

10. A panel system comprising at least one panel formed by a panelling member comprising at least two elongate sheet members each having at least one edge, said sheet members being placed side-by-side with said edges adjacent; and hinge means hingedly joining said sheet members, and at least one flexible elongated carrier strip having at least one notch in one longitudinal edge thereof, said notch being shaped to receive an edge of a sheet member of said panel, and a barbed projection in said notch engaging an aperture defined in a sheet member of said panel for securing said panel to said strip.

11. A panelling member according to claim 1 wherein at least two of said sheet members are laterally curved in opposite senses of curvature.

12. A panel system according to claim 11 wherein said barbed projections from the apex of each said notch.

13. A panel system according to claim 11 wherein said barbed projections project from sides of said notches.

14. A panel system according to claim 12 wherein said barbed projections are not as long as said notches are deep.

15. A panel system according to claim 11 further comprising an elongated stiffening strip engageable with said carrier strip along the other longitudinal edge thereof.

16. A panel system according to claim 11 wherein the or each panel comprises at least three sheet members, and said carrier holds at least one side sheet member of the or each panel so as to present at least a central one of said sheet members as an outer surface of the panel system.

17. A panel system according to claim 16 wherein plural central sheet members of one or more panels are held generally coplanar with respect to each other.

18. A panel system according to claim 11 wherein said hinge means comprises at least one strip of flexible material adhered to both side-by-side sheet members.

19. A panel system according to claim 18 wherein said flexible material is a fabric.

20. A panel system according to claim 18 wherein said flexible material is a fabric.

21. A panel system according to claim 11 wherein at least one of said sheet members is made from metal.

22. A panel system according to claim 21 wherein at least one of said sheet members if made from an aluminum alloy.

23. A panel system according to claim 11 comprising an odd number of sheet members and wherein at least a central one of said sheet members is wider than the others.

24. A panel system according to claim 11 wherein at least one of said sheet members is decorated or perforated.

25. A panel system according to claim 11 wherein at least two of said sheet members are laterally curved in the same sense of curvature.

26. A panel system according to claim 11 wherein at least one of said sheet members has a lateral curved cross-section.

27. A method of installing a panelling member comprising at least two elongate sheet members hingedly joined along adjacent edges in side-by-side relation and rolled in a flat configuration, the method comprising the steps of: unrolling said panelling member, moving the free edges thereof to impart rigidity, and installing the panelling member in a desired position.

28. A method according to claim 27 comprising the further step of mounting the rigid panelling member on a carrier.

29. A method according to claim 27 or 28 comprising the further step of cutting said panelling member into lengths.

* * * * *

UNITED STATES PATENT AND TRADEMARK OFFICE

CERTIFICATE OF CORRECTION

PATENT NO. : 5,475,962

DATED : Dec. 19, 1995

INVENTOR(S) : Antonius J. J. Horsten, et al.

It is certified that error appears in the above-indentified patent and that said Letters Patent is hereby corrected as shown below:

| | |
|---|---|
| Cover page [56] References Cited U.S. Patent Documents | Insert the following citations:<br>5,115,611 05/1992 Lim et al.<br>5,265,333 11/1993 Lim et al. |
| Cover page [56] References Cited Foreign Patent Documents | Insert the following citations:<br>339562 11/1974 Austria<br>475486 03/1992 Europe<br>2312625 01/1977 France<br>2830935 07/1978 Germany<br>2927969 07/1979 Germany<br>2021186 11/1979 Great Britain<br>279616 no date Netherlands<br>7014103 no date Netherlands<br>7600751 01/1976 Netherlands<br>WO 8505391 12/1985 PCT |
| Col. 6, line 10 (claim 12) | Reference to "claim 11" should be --claim 10-- |
| Col. 6, line 11 (claim 12) | After "projections" insert --project-- |
| Col. 6, line 12 (claim 13) | Reference to "claim 11" should be --claim 10-- |

UNITED STATES PATENT AND TRADEMARK OFFICE

CERTIFICATE OF CORRECTION

PATENT NO. : 5,475,962

DATED : Dec. 19, 1995

INVENTOR(S) : Antonius J. J. Horsten, et al.

It is certified that error appears in the above-indentified patent and that said Letters Patent is hereby corrected as shown below:

| | |
|---|---|
| Col. 6, line 17 (claim 15) | Reference to "claim 11" should be --claim 10-- |
| Col. 6, line 20 (claim 16) | Reference to "claim 11" should be --claim 10-- |
| Col. 6, line 29 (claim 18) | Reference to "claim 11" should be --claim 10-- |
| Col. 6, line 37 (claim 21) | Reference to "claim 11" should be --claim 10-- |
| Col. 6, line 41 (claim 23) | Reference to "claim 11" should be --claim 10-- |
| Col. 6, line 44 (claim 24) | Reference to "claim 11" should be --claim 10-- |
| Col. 6, line 46 (claim 25) | Reference to "claim 11" should be --claim 10-- |

UNITED STATES PATENT AND TRADEMARK OFFICE

CERTIFICATE OF CORRECTION

PATENT NO. : 5,475,962

DATED : Dec. 19, 1995

INVENTOR(S) : Antonius J. J. Horsten, et al.

It is certified that error appears in the above-indentified patent and that said Letters Patent is hereby corrected as shown below:

| | |
|---|---|
| Col. 6, line 50 (claim 26) | Reference to "claim 11" should be --claim 10-- |
| Col. 6, line 56 (claim 27) | After "thereof" insert --together-- |

Signed and Sealed this

Twenty-second Day of April, 1997

Bruce Lehman

*Attest:*

BRUCE LEHMAN

*Commissioner of Patents and Trademarks*

*Attesting Officer*